US006257466B1

(12) United States Patent
Muroi et al.

(10) Patent No.: US 6,257,466 B1
(45) Date of Patent: Jul. 10, 2001

(54) CONTINUOUS CASTING NOZZLE

(75) Inventors: Toshiyuki Muroi; Kazumi Oguri, both of Gifu (JP)

(73) Assignee: Akechi Ceramics Kabushiki Kaisha (JP)

( * ) Notice: Subject to any disclaimer, the term of this patent is extended or adjusted under 35 U.S.C. 154(b) by 0 days.

(21) Appl. No.: 09/529,688

(22) PCT Filed: Apr. 9, 1999

(86) PCT No.: PCT/JP99/01892

§ 371 Date: Apr. 17, 2000

§ 102(e) Date: Apr. 17, 2000

(87) PCT Pub. No.: WO00/61321

PCT Pub. Date: Oct. 19, 2000

(51) Int. Cl.[7] ..... B22D 35/00
(52) U.S. Cl. ..... 222/606; 501/101
(58) Field of Search ..... 266/280, 286; 222/606, 607; 501/84, 101, 99

(56) References Cited

U.S. PATENT DOCUMENTS 5,858,261 * 1/1999 Muroi et al. ..... 222/606
5,911,900 * 6/1999 Muroi et al. ..... 222/606
5,975,382 * 11/1999 Muroi et al. ..... 222/606

FOREIGN PATENT DOCUMENTS 57-056377 4/1982 (JP) .
57-205377 12/1982 (JP) .
59-121146 7/1984 (JP) .
63-303666 12/1988 (JP) .
2-172859 7/1990 (JP) .
10-118749 5/1998 (JP) .
10-166115 6/1998 (JP) .
10-166116 6/1998 (JP) .

* cited by examiner

*Primary Examiner*—Scott Kastler
(74) *Attorney, Agent, or Firm*—Cantor Colburn LLP

(57) ABSTRACT

A continuous casting nozzle for casting molten steel, wherein the surface layer of the bore of said continuous casting nozzle contacting with the molten steel is formed of a refractory material comprising silicon carbide from 1 to 10 wt %, an aggregate comprising alumina or an aggregate which comprises alumina as main component whose melting point is not less than 1800 degree C. from 15 to 60 wt %, and roseki as a main component from 30 to 84 wt %.

6 Claims, 1 Drawing Sheet

CONTINUOUS CASTING NOZZLE

FIELD OF THE INVENTION

The present invention relates to a continuous casting nozzle for enabling effective prevention of narrowing or clogging of the nozzle bore through which molten metal including steel passes during continuous casting of the molten metal including steel containing aluminum such as aluminum-killed steel used for automobile sheet.

THE RELATED ART

A continuous casting nozzle for casting molten steel is used for the purposes as indicated in the following.

As for continuous casting molten steel, a continuous casting nozzle is used for preventing the molten steel from being oxidized by contacting with the open air and from splashing when the molten steel is poured from a tundish to a mold, and rectifying the flow of the molten steel poured for preventing non-metallic inclusion and slag present near or on the mold surface from being entrapped in the cast steel strand.

Material of a conventional continuous casting nozzle of molten steel comprises such material as graphite, alumina, silica, and silicon carbide. However, there are following problems in the case of casting aluminum-killed steel and the like.

As for the aluminum-killed steel and the like, aluminum, which is added as a de-oxidizer and a stabilizing element in the steel, reacts with oxygen existing in the molten steel to produce non-metallic inclusion such as $\alpha$-alumina. Therefore, in casting the aluminum-killed steel and the like, the non-metallic inclusion such as alumina adheres and accumulates onto the surface of the bore of the continuous casting nozzle, so that the bore is narrowed or clogged up in the worst case, which makes stable casting difficult. Furthermore, the non-metallic inclusion such as alumina adhered or accumulated onto the surface of the bore is peeled off or falls down, and is entrapped in the cast steel strand, thus degrading the quality of the cast steel strand.

To prevent the above-mentioned narrowing or clogging of the bore caused by the non-metallic inclusion such as alumina, there is proposed a commonly used method for preventing the non-metallic inclusion such as alumina existing in the molten steel from adhering or accumulating on the surface of the bore of the nozzle, wherein inert gas is ejected from the inner surface of the nozzle bore toward the molten steel flowing through the bore (for example, Japanese Patent Publication No. Hei 6-59533/1994).

However, there are problems of the above mentioned method as described below wherein the inert gas is ejected from the inner surface of the nozzle bore. A large amount of the ejected inert gas causes entrapment of bubbles produced by the inert gas into the cast steel strand, resulting in defects caused by pinholes. On the other hand, a small amount of the ejected inert gas can not prevent adhesion and accumulation of the non-metallic inclusion such as alumina onto the surface of the bore of the nozzle, thus causing narrowing or clogging, in the worst case, of the bore.

Additionally, it is difficult to uniformly eject the inert gas from the inner surface of the nozzle bore toward the molten steel flowing through the bore because the injected gas can not be distributed along the bore. Arid in the case that the casting is performed in a long period of time, a stable control of the amount of ejected inert gas becomes gradually more difficult according as the structure of the material consisting of the continuous casting nozzle degrades. As a result, the non-metallic inclusion such as alumina adheres and accumulates onto the surface of the bore of the nozzle so that the bore is narrowed or clogged up eventually.

It is considered that the clogging of the nozzle by the non-metallic inclusion, specially by alumina inclusion, is caused as described below.

(1) Alumina inclusion is produced from aluminum existing in the steel by secondary oxidation, such as oxidation by air passing through a refractory junction and refractory structure or oxidation by supplying oxygen caused by reduction of silica in a carbon-containing refractory.

(2) Alumina inclusion is produced by diffusion and cohesion of the alumina produced in the above process.

(3) Carbon on the surface of the nozzle bore vanishes and the surface of the bore becomes rough and thus the alumina inclusion is apt to accumulate on the rough surface of the bore.

On the other hand, as a counterplan in view of nozzle material, an alumina-graphite nozzle is proposed which contains a non-oxide raw material such as SiC, $Si_3N_4$, BN, $ZrB_2$, SIALON, etc. as a component having a low reactivity with aluminum oxide, or a nozzle consisting of the non-oxide material itself is proposed (for example, Japanese Patent Publication No. Sho 61-38158/1986).

However, this counterplan is not practical in the case of the alumina-graphite nozzle, because the adhesion preventing effect is not recognized and further corrosion resistance is decreased unless much of the non-oxide material is added. Also, the nozzle consists of only the non-oxide material is not suitable for practical use in view of material cost and manufacturing cost, although a substantial effect is expected.

A nozzle consisting of graphite-oxide raw material containing CaO is proposed for producing low-melting-point material by a reaction of CaO in an oxide raw material containing CaO ($CaO.ZrO_2$, $CaO.SiO_2$, $2CaO.SiO_2$, etc.) with $Al_2O_3$ and forming the low-melting-point material in steel (for example, Japanese Patent Laid-Open Publication No. Sho 62-56101). However, reactivity of CaO with $Al_2O_3$ is apt to be influenced by the temperature of the molten steel in casting and there is a case that the amount of CaO is not sufficiently secured for satisfying spalling resistance and erosion resistance when a plenty of $Al_2O_3$ inclusion is contained in steel. And furthermore, $ZrO_2$ which is melted away from the refractory material into steel will not float up from molten steel because of a high density.

OBJECT OF THE INVENTION

The object of the present invention is to provide a continuous casting nozzle having following features.

(1) A glassy layer should be formed at the surface of the bore of the nozzle during casting, thereby preventing air from being penetrated in molten steel through refractory structure, which prevents alumina from being produced.

(2) The erosion of the bore should be prevented by reaction products having a low-melting-point on account of a reaction between an aggregate in the refractory and alumina in the steel.

And a smooth surface of the nozzle bore should be produced without the use of mechanical means such as the ejecting of an inert gas.

(3) A continuous casting nozzle should be provided which is able to prevent the bore from narrowing or clogging economically, comparatively easy and stably.

SUMMARY OF THE INVENTION

In the first embodiment of the present invention, the surface layer of the bore of a continuous casting nozzle contacting with molten steel is formed of a refractory material comprising silicon carbide from 1 to 10 wt % , aggregate consisting of alumina or an aggregate which comprises alumina as main component whose melting point is not less than 1800 degree C. from 15 to 60 wt %, and roseki as a main component from 30 to 84 wt % .

The second embodiment of the present invention, the surface layer of the bore of a continuous casting nozzle contacting with molten steel is formed of a refractory material comprising silicon carbide from 1 to 10 wt % , aggregate consisting of alumina or an aggregate which consists of alumina as main component whose melting point is not less than 1800 degree C. from 15 to 60 wt %, and roseki as a main component from 30 to 84 wt %, said refractory material being added binder, kneaded, formed, and sintered in non-oxidizing atmosphere.

It is preferable that said roseki comprises a roseki having a diameter equal to or less than 250 $\mu$m contains equal to or less than 60 wt % relative to the whole of the roseki so as to form a glass layer at the surface contacting with the molten steel.

Further it is preferable that the roseki is calcinated at a temperature equal to or more than 800° C. so as to vanish crystal water. It is also preferable that the roseki contains pyrophyllite($Al_2O_3.4SiO_2.H_2O$) as the main component. And it is recommended that said binder is thermosetting resin.

BRIEF DESCRIPTION OF THE DRAWINGS

FIG. 3 shows the composition of the refractory and physical properties of the invented nozzle and comparative nozzles material in Table 1.

EMBODIMENTS OF THE INVENTION

Figure 1:
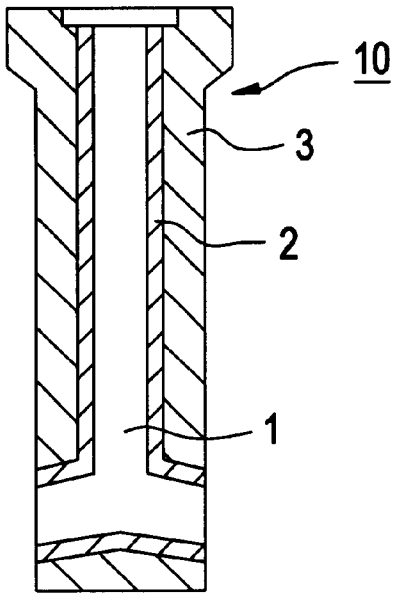
FIG. 1 shows a cross section of a nozzle according to the present invention comprising a refractory material at the surface layer of the bore of the nozzle contacting with molten steel.

A major characteristic of a continuous casting nozzle of the present invention is that the main components of the surface layer of the bore of a refractory material are roseki and silicon carbide at the same time. When roseki is coexisting with silicon carbide, so called bloating is apt to occur in a lower temperature whereby air penetration through the nozzle refractory is reduced. Further it should be noted that graphite is not contained which is normally contained in nozzle refractory material. Graphite reacts with silica in the nozzle refractory material as suggested in the following reactions when in use of nozzle in casting.

$$SiO_2(S)+C(S)=SiO(g)+CO(g)$$

$$3SiO(g)+2Al=Al_2O_3(S)+3Si$$

$$3CO(g)+2Al=Al_2O_3(S)+3C$$

As shown in the above reactions, decomposition of the silica produces SiO(g) and CO(g), thereby providing supply of oxygen source for the steel and which reacts with aluminum in the steel to form $Al_2O_3$. However, roseki particles do not decompose even if it is in contact with steel. Namely, $SiO_2$ in pyrophyllite ($Al_2O_3.4SiO_2.H_2O$) which is the main mineral of roseki is stable. This fact is found, from an experiment that a briquette consisting of roseki, resin powders and carbon powders was buried in a coke breeze and heat-treated at a temperature of 1500 degree C. for 24 hours. A microscopic observation of the particles after heat treatment did not show any decay and bubbles in the samples. Hence it is proved that $SiO_2$ in pyrophyllite ($Al_2O_3.4SiO_2.H_2O$) does not decompose even if it is contact with steel.

The conventional nozzle refractory which contains about 10 wt % graphite has a thermal conductivity of about 9.8 kcal/m/hr/degree C. and the present refractory material has a thermal conductivity of about 3.6 kcal/m/hr/degree C. Therefore the thermal conductivity of the present material is far less than that of the conventional material and hence freezing of metal and non-metallic inclusion including alumina inside of nozzle are far reduced.

Furthermore with respect to the conventional nozzle containing graphite, the inner surface of the nozzle bore become less smooth, thereby alumina included in steel is apt to stack on the inner surface of the bore. The present nozzle which does not contain graphite keeps the smooth inner surface of the bore and hence alumina in steel does not stack on the inner surface.

The half-melting temperature of roseki is about 1500 degree C., so that it melts at the working surface contacting with molten steel to form a glass coat for smoothing the surface of the bore and preventing air from being penetrated through a refractory structure.

This is found from the fact that the permeability of alumina-roseki material containing graphite showed that the permeability after performing heat-treatment at a temperature of 1500 degree C. for 1 hours is as large as $6.5\times10^{-2}$ darcy. In contrast the permeability of alumina-roseki without graphite after the same heat-treatment is as small as $1.0\times10^{-4}$ darcy. Furthermore alumina-roseki material showed that the permeability of the material after performing heat-treatment at a temperature of 1450°C. for 1 hours is as large as $10\times10^{-4}$ darcy, in contrast the permeability of alumina-roseki containing silicon-carbide after the same heat-treatment is as small as $1.0\times10^{-4}$ darcy. This shows that roseki underwent bloating at that low temperature and the penetration of air will be reduced.

To actively form a glassy coat on the surface of the bore in use as continuous casting nozzle, preferably, a mixing weight ratio of the roseki is preferably equal to or more than 30 wt %. Also it is preferably that the mixing weight ratio of the roseki is equal to or less than 84 wt % because the degree of deformation by softening is in an range of over 84 wt %. The mixing amount of silicon carbide is preferably equalor more than 1 wt % for giving rise of bloating and equal or less than 10 wt % foravoiding erosion of the refractory material during casting.

Alumina as aggregate or an aggregate comprising alumina as main component having a melting point equal or more than 1800 degree C. (for example $MgO.Al_2O_3$) should be from 15 to 60 wt % to enhance the strength and erosion resistance of the nozzle.

As for kinds of roseki, it is basically possible to use three kinds of roseki, that is pyrophyllite roseki, kaolin roseki, and sericite roseki. The pyrophyllite roseki with refractoriness from SK29 to SK32 (SK is a Japanese Standard for refractoriness ) is most preferable, considering formation of a glass layer and erosion resistance against the molten steel, as the surface of the bore contacting with the molten steel is half-molten in use. Both of the kaolin roseki and the sericite roseki are not preferable, because the kaolin roseki has a greater refractoriness from SK33 to SK36, and the sericite roseki has a smaller refractoriness from SK26 to SK29.

It is preferable that a mixing weight ratio of roseki with an average grain diameter equal to or less than 250 $\mu$m should be equal to or less than 60 wt % relative to the whole of the roseki content because, in the range of over 60 wt %, structure defects such as lamination are apt to be produced in molding and deformation by softening of roseki particles is apt to happen in continuous casting.

The reason for using the roseki calcinated at a temperature equal to or more than 800°C. to vanish crystal water is that the crystal water is released from the roseki in a temperature ranging from 500 to 800° C. in sintering. And hence the refractory cracks by virtue of an unusually large coefficient of thermal expansion in this range.

The refractory material, which comprises pyrophyllite ($Al_2O_3.4SiO_2.H_2O$) roseki from 30 to 84 wt %, alumina aggregate or an aggregate composed of alumina as main component whose melting point is equal to or more than 1800 degree C. from 15 to 60 wt % and silicon carbide from 1 to 10 wt %, does not decompose the roseki in use as nozzle and hence does not feed any oxygen to steel in contrast to silica which does feed oxygen to steel.

Further, a half-melting temperature of the roseki is about 1500 degree C. near a casting temperature of the molten steel, allowing formation of a glass coat layer at a working surface contacting with the molten steel, which smoothes the working surface structure and prevents air from penetrating and diffusing through the refractory structure. Therefore adhesion of alumina and freezing of metal onto the surface nozzle bore are prevented.

The above refractory material comprising the above composition can be formed to a continuous casting nozzle having any configuration. In the formation a thermosetting resin including phenol resin or furan resin is preferably mixed with the above refractory material in a range from 5 to 15 wt %, then formed to nozzle shape and then sintered. As the formation process CIP (Cold Isostatic Press) is most preferable because of homogeneous pressing in every direction. The sintering temperature between 1000 to 1300 degree C. is preferable and the sintering atmosphere is preferably a reducing atmosphere, namely a non-oxidizing atmosphere rather than an oxidizing atmosphere as the resin would not be oxidized.

BRIEF DESCRIPTION OF THE DRAWINGS

The continuous casting nozzle for steel according to the present invention will be described in detail with reference to the accompanying drawings.

FIG. 1 shows an embodiment of a vertical sectional view of the immersion casting nozzle according to the present invention. This nozzle 10 is placed between a tundish and a mold, and used as an immersed nozzle for pouring the molten steel from the tundish to the mold. As shown in FIG. 1, a surface layer 2 of the bore 1, through which the molten steel flows, of the continuous casting nozzle 10 comprises a refractory having the chemical composition as described above. The rest part of the nozzle 3 is composed of regular refractory material, for example, of alumina-graphite. The dimensions of the nozzle are about 1 m in length, about 6 cm in diameter of the bore, 16 cm in outer diameter, and about 5 cm in thickness. And, the thickness of the surface layer of the bore made of the refractory according to the present invention is from about 2 to 15 mm.

Figure 2:
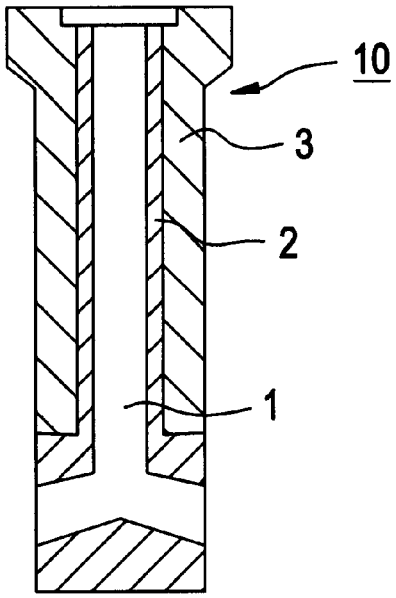
FIG. 2 shows cross section of a nozzle according to the present invention comprising a refractory material at the surface layer of the bore of the nozzle and the lower part (a part immersed in the molten steel) of the nozzle.

FIG. 2 shows another embodiment of a nozzle, wherein the whole part immersed in the molten steel in at the mold is formed of the refractory according to the present invention. In both of embodiments, alumina usually aggregates at the lower part of the nozzle bore and makes the stable flow of molten steel difficult. The immersed nozzle according to the present invention prevents adhesion or accumulation of non-metallic inclusion such as the alumina in the molten steel onto the surface layer 2. The present invention is now described by means of examples.

EXAMPLES

Sample materials with 9 different composition were prepared and powder and liquid phenol resin were added in an amount within a range of from 5 to 10 wt % to each of 9 sample materials. From the 9 sample materials the following formed bodies were prepared.

A first formed body (hereinafter referred to as the "formed body 1") with a dimension of 30 mm by 30 mm by 230 mm was prepared for examining an amount of adhesion of non-metallic inclusion such as alumina and erosion resistance against the molten steel. A second formed body (hereinafter referred to as the "formed body 2") with dimensions of ø50 mm by 20 mm was prepared for examining permeability. And a third formed body (hereinafter referred to as the "formed body 3") with dimensions of 100 mm in outer diameter, 60 mm in inner diameter and 250mm in length was prepared for examining spalling resistance. Then the bodies were sintered in reducing atmosphere at a temperature in a range from 1000 to 1200 degree C.

Thus, the samples Nos. 1 to 5 (hereinafter referred to as the "sample of the present invention") shown in Table 1 having the chemical compositions within the scope of the present invention and the samples Nos. 6 to 9 (hereinafter referred to as "sample for comparison") having chemical compositions out of the scope of the present invention were prepared.

Physical properties (porosity and bulk density) for each of the above-mentioned samples of the present invention Nos. 1 to 5 and the samples for comparison Nos. 6 to 9 are shown in Table 1.

The spalling resistance of each of the sintered formed bodies 3 of the samples of the present invention Nos. 1 to 5 and the samples for comparison Nos. 6 to 9 was examined after heating at a temperature of 1500 degree C. for 30 minutes in an electric furnace and then rapidly cooling in water. The results are also shown in Table 1.

An erosion ratio (%) and an amount of adhesion of non-metallic inclusion such as alumina of each of the sintered formed bodies 1 of the samples of the present invention Nos. 1 to 5 and the samples for comparison Nos. 6 to 9 were examined after immersing in molten steel, which contains aluminum in a range from 0.02 to 0.05 wt %, at a temperature of 1550 degree C. for 180 minutes. The results are also shown in Table 1.

The permeability for each of the sintered formed bodies 2 of the samples of the present invention Nos. 1 to 5 and the samples for comparison Nos. 6 to 9 was examined after heating at a temperature of 1450° C. for 60 minutes in an electric furnace and then cooling. The results are again shown in Table 1.

TABLE 1

Comparison of Chemical Compositions and Physical Properties between Samples

| | Sample of the invention No. | | | | | Sample for comparison No. | | | |
|---|---|---|---|---|---|---|---|---|---|
| | ① | ② | ③ | ④ | ⑤ | ⑥ | ⑦ | ⑧ | ⑨ |
| Composition (wt. %) | | | | | | | | | |
| Graphite | | | | | | | | | 10 |
| Roseki | 80 | 60 | 40 | 30 | 30 | 90 | 30 | 20 | 70 |
| $Al_2O_3$ | 15 | 35 | 55 | 60 | | 10 | 55 | 70 | 20 |
| SiC | 5 | 5 | 5 | 10 | 10 | | 15 | 10 | |
| $MgO.Al_2O_3$ | | | | | 60 | | | | |
| Physical Property | | | | | | | | | |
| Porosity (%) | 13.2 | 13.5 | 13.7 | 13.3 | 13.3 | 12.8 | 12.9 | 13.4 | 16.4 |
| Bulk density | 2.47 | 2.45 | 2.44 | 2.48 | 2.47 | 2.50 | 2.46 | 2.43 | 2.16 |
| Flexural Strength (Mpa) | 9.2 | 9.0 | 9.0 | 9.9 | 9.7 | 8.4 | 8.0 | 8.7 | 7.8 |
| Thermal conductivity (Kcal/m · hr · ° C.) | 2.9 | 3.6 | 3.7 | 4.0 | 4.1 | 2.0 | 2.4 | 2.8 | 9.8 |
| Erosion to molten steel (Temperature of molten steel 1500° C.) | 10 | 8 | 6 | 5 | 6 | 15 | 15 | 2 | 8 |
| Permeability ($10^{-4}$ × darcy) After Heat-treatment 1450° C. - 1 hr | 1.5 | 2.0 | 2.6 | 2.6 | 2.5 | 5.2 | 2.0 | 15 | 690 |
| Spalling resistance | No crack | No crack | No crack | No crack | No crack | No crack | No crack | Cracks | No crack |
| Amount of Alumina adhesion (mm) | ≈0 | ≈0 | ≈0 | ≈0 | ≈0.5 | 3 | 1 | 10 | 7 |
| Amount of metal adhesion (mm) (Temperature of molten steel 1500° C.) | ≈0 | ≈0 | ≈0 | ≈0 | ≈0.5 | 1 | 1 | 2 | 3 |

It is easily understood from Table 1 that the samples of the present invention are superior in the spalling resistance and the non-metallic inclusion such as alumina does not adhere in spite of the low erosion ratio, thereby effectively preventing reduction or clogging of the continuous casting nozzle of the molten steel.

Also, the samples of the present invention can prevent air from being penetrated through the refractory in practical use because of small permeability.

On the other hand, it is obvious that the sample for comparison No. 6 is remarkably inferior in the spalling resistance and the erosion resistance against the molten steel, although a small amount of alumina adheres due to much roseki content.

As for the sample No. 6 for comparison, the amount of adhesion of alumina is remarkably small. Yet the erosion of the sample by steel is large.

As for the sample No. 7 for comparison, a small amount of non-metallic inclusion such as alumina adheres and the erosion by steel is remarkable because of an excessive amount of silicon carbide in the composition which enhances bloating.

As for the sample No. 8 for comparison, the composition has a high content of alumina and a lower content of roseki whereby it has a high permeability and hence a high amount of adhesion of alumina. And spalling resistance is inferior to the other sample.

As for sample No. 9 for comparison, the composition comprises graphite, roseki and alumina. Because the sample contains graphite, a higher adhesion of alumina and freezing of metal were observed when the temperature of steel was as low as 1520±10 degree C.

ADVANTAGE OF THE PRESENT INVENTION

Therefore, according to the continuous casting nozzle of molten steel of the present invention, it is possible to perform stable casting with preventing narrowing or clogging of the bore caused by the non-metallic inclusion such as alumina without deterioration of the refractory structure.

According to the present invention, approximately 600 to 800 ton of a low carbon aluminum killed steel for automotive sheet (C:0.04 wt %, Mn:0.33 wt %, Al:0.051 wt %) is continuously cast with one nozzle without clogging by 2 strand slab caster.

Meanwhile, 360 to 480 ton of the same low carbon aluminum killed steel was continuously cast with one nozzle made of conventional alumina-graphite without clogging by the same caster.

What is claimed is:

1. A continuous casting nozzle for casting molten steel, wherein the surface layer of the bore of said continuous casting nozzle contacting with the molten steel is formed of a refractory material comprising silicon carbide from 1 to 10 wt % , aggregate consisting of alumina or an aggregate which comprises alumina as main component whose melting point is not less than 1800 degree C. from 15 to 60 wt %, and roseki as a main component from 30 to 84 wt % .

2. A continuous casting nozzle of molten steel, wherein the surface layer of the bore of the continuous casting nozzle contacting with the molten steel is formed of a refractory material comprising silicon carbide from 1 to 10 wt %,an aggregate comprising alumina or an aggregate which comprises alumina as main component whose melting point is not less than 1800 degree C. from 15 to 60 wt %, and roseki as a main component from 30 to 84 wt % , said refractory material being added binder, kneaded, formed, and sintered in the reducing atmosphere.

3. A continuous casting nozzle according to claim 2, wherein a mixing weight ratio of said roseki of an average grain diameter equal to or less than 250 $\mu$m is equal to or less than 60 wt % relative to the whole of the roseki content.

4. A continuous casting nozzle according to claim 1, wherein said roseki is calcinated at a temperature equal to or more than 800° C. so as to vanish crystal water.

5. A continuous casting nozzle according to claim 1, wherein said roseki comprises pyrophyllite ($Al_2O_3.4SiO_2.H_2O$) as mineral component.

6. A continuous casting nozzle according to claim 2, wherein said binder is a thermosetting resin.

* * * * *